United States Patent [19]

Heuer et al.

[11] Patent Number: 4,804,984

[45] Date of Patent: Feb. 14, 1989

[54] PACKAGED CAMERA ASSEMBLY

[75] Inventors: William H. Heuer, Arlington Heights; Hari Matsuda, Evanston, both of Ill.

[73] Assignee: W. Haking Enterprises Limited, Hong Kong

[21] Appl. No.: 87,340

[22] Filed: Aug. 20, 1987

[51] Int. Cl.[4] ..... G03B 29/00; B65D 73/00

[52] U.S. Cl. ..... 354/76; 206/316; 206/461

[58] Field of Search ..... 354/75, 76, 81, 354; 206/461, 316, 45.24; 224/908

[56] References Cited

U.S. PATENT DOCUMENTS

| | | | |
|---|---|---|---|
| 3,083,826 | 4/1963 | Weinstein | 206/316 |
| 3,278,015 | 11/1966 | Bernstein | 206/316 |
| 4,235,336 | 11/1980 | Dudas et al. | 206/461 |
| 4,669,610 | 6/1987 | Lindsey et al. | 206/461 |

*Primary Examiner*—A. A. Mathews

*Attorney, Agent, or Firm*—Wallenstein, Wagner, Hattis & Strampel, Ltd.

[57] ABSTRACT

A packaged camera assembly comprises a camera enclosed by a clam shell container of elongated rectangular shape so that the container is at least about twice as long as it is wide. A camera is supported between closely confronting transparent main walls of front and rear sections of the clam shell container which have outwardly projecting pockets for receiving the front and rear halves respectively of the camera. The camera is supported in the container so that the long dimension of its front face angles at least about 45 degrees and preferably about 60 degrees from the narrow dimension of the container. The container preferably has a display card sandwiched between said transparent main walls, the card having an aperture through which the camera passes. The container has support means along its long and short margins to support the packaged assembly upright for display with its long dimension upright or horizontal. The display card has camera identifying indicia with letters angled about 45 degrees so that the display card can be read when the packaged camera assembly has either one of the described display orientations.

9 Claims, 2 Drawing Sheets

PACKAGED CAMERA ASSEMBLY

FIELD OF THE INVENTION

This invention relates to the packaging of still cameras, particularly to the packaging of relatively low cost 35 mm., 110 and disc cameras.

BACKGROUND OF THE INVENTION

In recent years, relatively inexpensive cameras have been sold in blister or clam shell packages which are hung from horizontal support rods in mass merchandising stores like supermarkets and discount stores. Clam shell packages usually comprise a transparent outer container made of a thin but rigid self-supporting plastic material. It has front and rear sections with closely confronting main walls with peripheral interleaving flanges which are heat sealed. The container section main walls closely envelope a display card having camera identifying indicia and an aperture through which the camera extends. The front and rear halves of the camera project into pockets projecting forwardly and rearwardly respectively from the front and rear container sections. The camera is fully visible from both the front and rear of the clam shell container. Sometimes the bottom of the rear container section includes a rearwardly projecting support foot which enables the packaged camera to be stood upright on a counter top. The container also has a hole at the top thereof for hanging the packaged camera on a horizontal support rod.

When a disc or 35 mm. camera was involved, the camera was supported by the clam shell container so that the front wall or face of the camera is parallel to the main wall of the front container section and the longer dimension of the camera was slightly angled with respect to the horizontal. In the case of a 110 camera with a built-in flash, which has a thin horizontal profile with a length generally much longer than that of a 35 mm. camera, the long dimension of the camera was also slightly angled to the horizontal. Because the long dimension of these cameras is oriented primarily in a horizontal direction, the packaged cameras had a substantial width. To expose the lens side of the 110 camera to the front of the container and minimize the thickness of the package, it was necessary to support the camera so that the lens axis was at an angle to the horizontal. The angle chosen directed the lens axis downwardly. Where the lens side of the camera was not readily visible at most viewing angles or camera positions, which was generally horizontal or above the camera. The substantial width of the packaged camera required a substantial horizontal display space, which is generally much more limited than is the vertical space for displaying merchandise.

SUMMARY OF THE INVENTION

In accordance with one of the features of the invention, a unique clam shell packaged camera is provided having a unique camera orientation, enabling the package to be made much narrower than the prior art packaged cameras. To this end, the long dimension of the front face of a 35 mm. camera extends at least about a 45 degree angle and preferably much more to the horizontal and, in the case of the 110 camera, at a much greater angle than 45 degrees to the horizontal. The width of the package is thus made much less than the length of the camera, so that as many as three packages can be supported side by side where previously only two such clam shell packages could be accommodated. Also, in the case of the 110 cameras, the lens axis, instead of pointing at an angle downwardly where it cannot be readily seen when the viewer views the package from above the camera, is angled upwardly so that both the lens side and the normally top shutter button-containing top side of the camera are readily visible when viewed along a horizontal or downwardly extending line of sight.

In accordance with another feature of the invention, the camera has one or more support feet along both the short and long sides of the clam shell container, so that the package can be supported upright on a counter top in a position where the long dimension thereof is horizontal, providing a maximum stability, or where the long dimension is vertical where it occupies a minimum of counter top space but has minimum stability.

The above and other advantages and features of the invention will become apparent upon making reference to the specification to follow, the drawings and the claims.

DESCRIPTION OF EXEMPLARY FORMS OF THE INVENTION SHOWN IN THE DRAWINGS

Figures 1, 2, 3, 4, 5, 6:
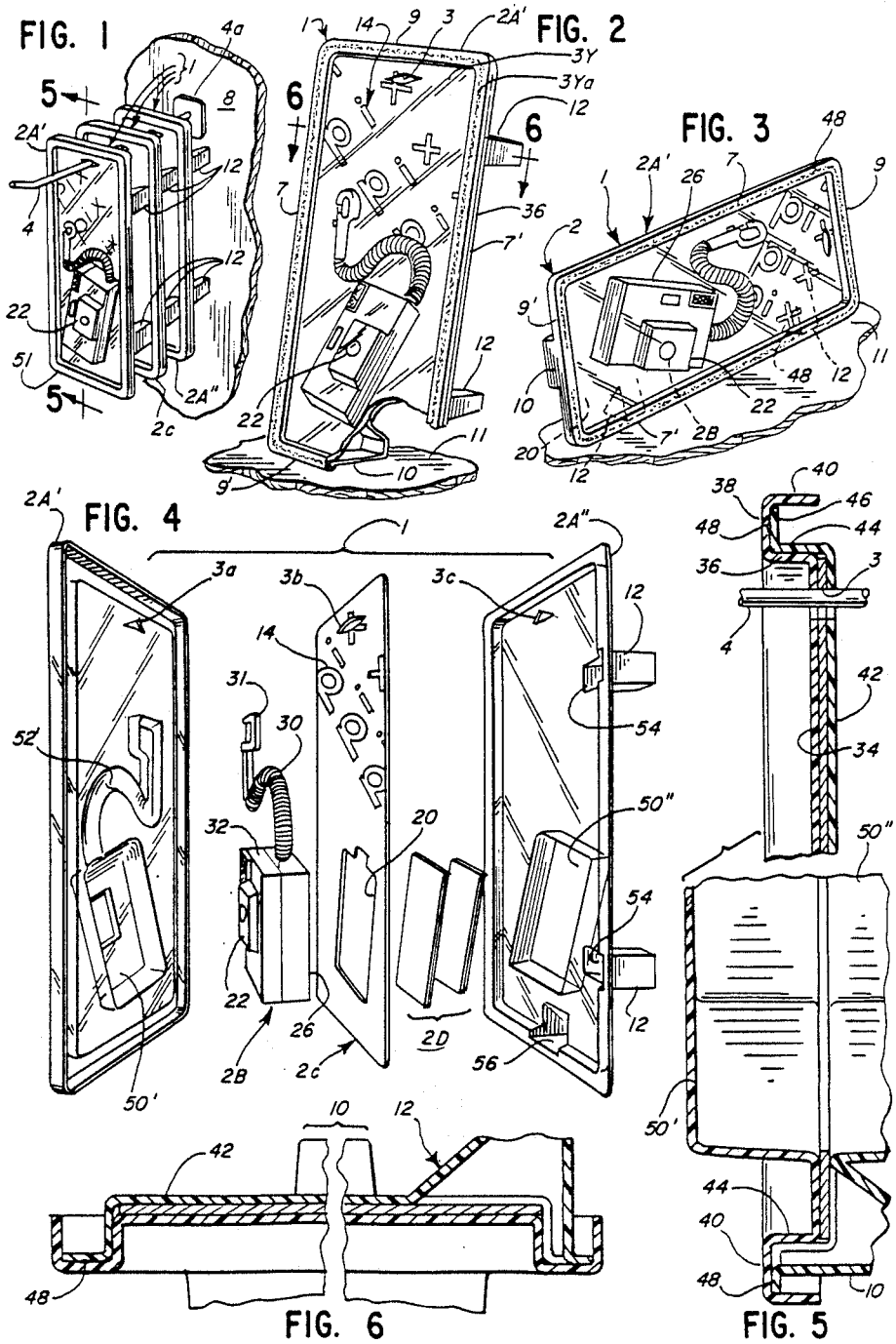
FIG. 1 is a perspective view of three of the packaged 35 mm. camera assemblies of the present invention hung on a horizontal support post.
FIG. 2 is a perspective view of one of the packaged camera assemblies shown in FIG. 1 supported upright on a horizontal support surface by means of a rearwardly extending projection along the narrow margin of the assembly.
FIG. 3 is a perspective view of the packaged camera assembly shown in FIG. 2 supported upright on the horizontal support surface at an orientation at right angles to that shown in FIG. 2 by means of a pair of rearwardly extending projections along the longer margin of the assembly.
FIG. 4 is an exploded view showing the different components making up the packaged camera assembly of FIGS. 1 through 3.
FIG. 5 is a fragmentary, greatly enlarged, vertical sectional view through one of the packaged camera assemblies shown in FIG. 1, taken along section line 5—5 therein.
FIG. 6 is a greatly enlarged, fragmentary horizontal sectional view taken through the packaged camera assembly of FIG. 2, taken along section lines 6—6 therein.

The present invention provides a relatively inexpensive packaged camera assembly 1 for a 35 mm. camera which can be displayed at the point of sale in three different ways shown respectively in FIGS. 1–3. In FIG. 1, each of the packaged 35 mm. camera assemblies is supported on a horizontal support rod 4 which passes through larger sized openings 3 in each of the assemblies. Each assembly includes a transparent clam shell container made of front and rear container sections 2A',-2A", a 35 mm. camera 2B, a display card 2C, and a printed booklets 2D. The clam shell container is of elongated, rectangular shape so as to present relatively long parallel margins 7—7' illustrated having a length at least twice that of the narrower parallel margins 9—9' thereof. The openings 3 are located near the top narrow margin 9 of the container 2. The camera 2B, which is visible through the transparent front and rear walls of the container, is located in the lower half of the clam shell container to place the center of gravity of the packaged camera assembly at a low point. To enable the container to be much narrower than camera clam shell containers previously used, the relatively long dimension of the camera 2B is oriented with its long dimension extending at an angle to the horizontal of at least about 45 degrees, preferably as much as about 60 degrees. For a 110 camera 2B' with built-in flash, like that shown in FIG. 7, this angle is also preferably about 60 degrees. A large number of rows of packaged camera assemblies thus can be supported on horizontal support rods 4 spaced fairly close together.

FIG. 2 shows one of the packaged camera assemblies in FIG. 1 supported on a display counter top 11, the assembly being self-supporting by means of a rearwardly extending support foot 10 located along the narrow bottom margin 9' of the rear section 2A" of the clam shell container. The bottom of the support foot 10 is positioned so that the assembly is supported at a slight angle to the vertical.

FIG. 3 shows the packaged support assembly of FIG. 2 supported on the counter top 11 along the long margin 7' of the container 2 by means of a pair of horizontally spaced support feet 12—12 projecting rearwardly from the rear container section 2A". In all the support orientations of the packaged camera assemblies, the front lens-aperture containing front wall or face 22 of the camera 2B is readily visible.

The container sections 2A'-2A" have transparent rearwardly recessed main upright walls 34 and 42, and forwardly projecting peripheral flange sections which interleave as shown in FIG. 5. The display card 2C is sandwiched between the walls 34 and 42. It has printed indicia 14 thereon illustrated as being the repeated trademark "PIX", which have their letters aligned along lines angling at about 45 degrees so that they are readily readable when the packaged assembly is supported along its narrow or long margin 7' or 9'. The display card 2C has a support rod-receiving opening 3*b* which is aligned with similar openings 3*a*-3*c* formed in the main vertical walls 34-42 of the front and rear clam shell container sections 2A'-2A".

The peripheral flanged section of the front clam shell container section 2A, is comprised of a forwardly extending wall section 36, a vertical extending wall section 38, and a rearwardly extending wall section 40. The peripheral flanged section of the rear clam shell container section 2A" has a forwardly extending wall section 44 and a vertically extending wall section 46. The forwardly facing peripheral wall sections 46-38 of the rear and front clam shell container sections 2A'-2A" are heat sealed at 48 along substantially their entire length.

The display card 2C has a rectangular aperture 20 which receives the similarly sized and shaped rectangular margins of the housing of the camera 2B. The front container section 2A' has aligned with the card opening 20 a forwardly projecting camera housing-receiving pocket 50, formed in the wall 34, adapted to loosely enclose the forward half of the housing of the camera 2B. The container section 2A" has a rearwardly projecting, similarly positioned, sized and shaped camera housing-receiving pocket 50" formed in the wall 42 for receiving the rear half of the housing of the camera 2B. The camera 2B has a spiral cord 30 (FIG. 4) supported in a curved position and terminating in a spring-biased clamp 31 for securing the camera to the user's belt or purse strap. The wall 34 of the front container section 2A, has a pocket 52' for receiving the attractively curved cord 30 and the spring-biased clamp 31 of the camera 2B. The cord 30 is visible from the front of the packaged camera assembly and supplies an important aesthetic element to the display of the camera in the container 2.

FIGS. 2 and 5 show the support foot 10 formed by a rearwardly bulging portion of the main wall 42 of the rear container section 2A" and FIG. 6 shows the rearwardly projecting feet 12—12 of the rear container section 2A" formed by rearwardly bulging portions of the main wall 42.

Figure 7:
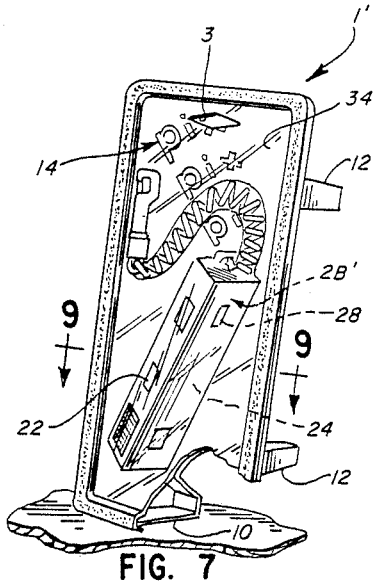
FIG. 7 is a perspective view of the packaged camera assembly of the invention for a 110 camera, where the camera is supported in an upright position by a support foot at the bottom narrow margin of the assembly, as seen from the front thereof.
Figure 8:
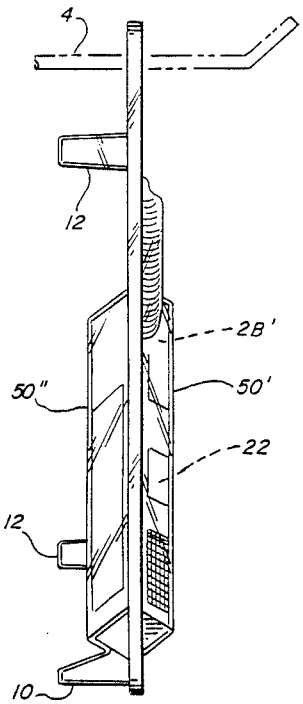
FIG. 8 is a side elevational view of the packaged camera assembly of FIGS. 7 and 8.
Figure 10:
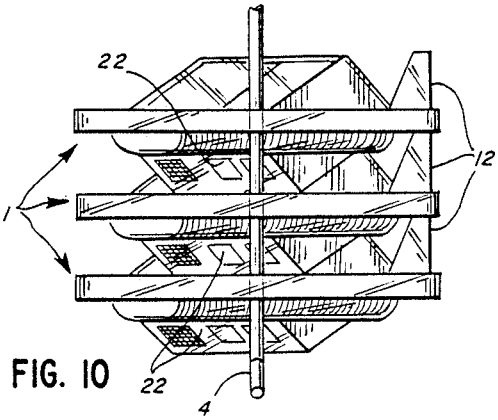
FIG. 10 is a top plan view showing three of the packaged camera assemblies shown in FIG. 7 supported on a horizontal support post.
Figure 9:
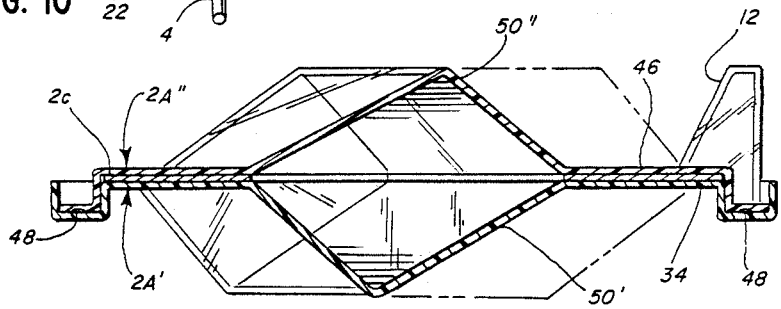
FIG. 9 is a horizontal sectional view of the packaged camera assembly of FIG. 7, taken along section line 9—9 therein.

As previously indicated, FIG. 7 shows a perspective front view of a packaged camera assembly 1' for a 110 camera with a built-in flash. FIG. 7 uses reference numbers corresponding to the numbers used in FIGS. 1-6 for the corresponding elements. The 110 camera 2B' thereof has its front lens-containing wall 22 on a narrow, low profile side of the camera housing, where a problem exists in displaying this narrow side of the camera so that it faces the front of the container 2 without unduly increasing the thickness of the packaged camera assembly. If this narrow side of the camera would be oriented parallel to the wall 34 of the container 2, the wide or deep dimension of the camera would be at right angles to the wall 34. In the assembly of FIG. 1, the front face of the 35 mm. camera 2B is parallel to the container wall 34 where the relatively shallow dimension of the camera is at right angles thereto. To orient the 110 camera 2B, so that the narrow lens-containing wall 22 thereof and the wall 24' which contains the shutter button 28 are both visible from the front or top of the package assembly and to minimize the depth of the packaged camera assembly, the camera 2B, is supported in the container 2 so the lens axis is pointed upwardly at an angle to the vertical. FIG. 8 shows pocket-forming walls 50' and 50" of the walls 34 and 42 of the container 2 inclining substantially with respect to the plane of the main container walls 34 and 42.

The present invention, in its most preferred form, has thus provided an extremely flexible, low cost packaged camera assembly which substantially reduces the horizontal space necessary to display the camera merchandise involved in one of its orientations. Its construction permits the selective display of the packaged camera assembly on either horizontal support rods or supported on a counter top in a position where the long dimension of the package is selectively vertical or horizontal. In all of these display positions, the printed material involved is readily readable and the cameras are oriented so that both the lens-containing wall and preferably the top pushbutton containing wall of the camera are both visible when the camera is either viewed in a horizontal direction of from a point above the same.

While the invention has been described with reference to a preferred embodiment, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention should not be limited to such details. Furthermore, while, generally, specific claimed details of the invention constitute important specific aspects of the invention in appropriate instances even the specific claims involved should be construed in light of the doctrine of equivalents.

We claim:

1. In a packaged camera assembly comprising a camera having a front lens-containing wall and a rear wall, the camera front wall having a length in one direction which is much longer than that in a direction transverse thereto, a rectangular-shaped clam shell container enclosing said camera, said container having a first pair of parallel margins and a second pair of parallel margins at right angles to said first pair of margins, the clam shell container comprising front and rear container sections having main walls in close confronting relation, at least a main wall of said front container section being transparent and having a forwardly projecting pocket of about the same size and shape as the side of said camera containing the front lens-containing wall and into which at least this side of the camera extends, camera information indicia on the front of said main wall of said rear container section at points to one side of said camera and being visible through the transparent main wall of said front container section, and the clam shell container having first support means for supporting the packaged camera assembly upright, the improvement wherein said clam shell container has an elongated, rectangular shape, wherein said first pair of parallel margins are substantially longer than said second pair of parallel margins, the camera being mounted in said container so that the front wall of the camera is visible from the front of the container and the long dimension of said front camera wall is at an angle of at least about 45 degrees to the shorter second pair of parallel container margins, and support means on said clam shell container for supporting said packaged camera assembly in an upright position so that the longer first pair of margins of said container extend upwardly to present a display occupying a minimum space in a horizontal direction.

2. In a packaged camera assembly comprising a camera having a front lens-containing wall and a rear wall; a rectangular-shaped clam shell container enclosing said camera, said container having a first pair of parallel margins and a second pair of parallel margins at right angles to said first pair of margins, the clam shell container comprising front and rear container sections having main walls in close, confronting relation, at least a main wall of said front container section being transparent and having a forwardly projecting pocket of about the same size and shape as the side of said camera containing the front lens-containing wall and into which at least this side of the camera extends, camera information indicia on the front of said main wall of said rear container section at points to one side of said camera and being visible through the transparent main wall of said front container section, and the clam shell container having first support means for supporting the packaged camera assembly upright, the improvement wherein the clam shell container has second support means along one of said second pair of parallel margins for supporting the packaged camera assembly along the latter margin so that the packaged assembly can be supported for display purposes with two transversely related orientations, said indicia having letters aligned in a direction making a substantial angle to both the vertical and horizontal, wherein it is readily readable when said package assembly is supported upright in either of said orientation.

3. The packaged camera assembly of claim 1 or 2 wherein said first support means includes aperture means near the top of said container for receiving a horizontal support rod upon which the packaged assembly can be suspended.

4. The packaged camera assembly of claim 3 wherein there is provided around said camera a display board which contains said indicia and is sandwiched between said main walls of said front and rear container sections.

5. The packaged camera assembly of claim 2 wherein said indicia has letters inclined at about 45 degrees to the horizontal when the assembly is supported in either of said orientations.

6. The packaged camera assembly of claim 1 or 2 wherein said first support means is a support foot means projecting from said container.

7. The packaged camera assembly of claim 2 wherein said second support means is at least one rearwardly extending projection on said rear container section.

8. The packaged camera assembly of claim 2 wherein said clam shell container has a substantially elongated rectangular profile so that said second pair of parallel margins thereof is at least of the order of magnitude of twice the length of said first pair of parallel margins.

9. A package camera assembly comprising a camera having an elongated front face having long and short dimensions, a clam shell container of an elongated rectangular shape so that the long dimension of said container is at least about twice as long as the narrow dimension thereof, camera supported between closely confronting transparent main walls of front and rear sections of the clam shell container with outwardly projecting pockets for receiving the front and rear halves of the camera, said camera being supported in the container so the long dimension of its front face angles at least about 45 degrees from the narrow dimension of the container, a display card sandwiched between said transparent main walls, the card having an aperature through which the camera passes and support means along one of the margins and along one of the short margins of the container to support the packaged assembly upright for display with its long dimension in upright of horizontal display orientations, and said display card having camera identifying indicia with letters angled about 45 degrees so that the display card can be read when the packaged camera assembly has either one of said display orientations.

* * * * *